US008398380B2

(12) United States Patent
Duke

(10) Patent No.: US 8,398,380 B2
(45) Date of Patent: Mar. 19, 2013

(54) CENTRIFUGAL BLOWER WITH NON-UNIFORM BLADE SPACING

(75) Inventor: Connor Raymond Duke, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 716 days.

(21) Appl. No.: 12/552,857

(22) Filed: Sep. 2, 2009

(65) Prior Publication Data

US 2011/0052385 A1 Mar. 3, 2011

(51) Int. Cl.
*F04B 35/04* (2006.01)

(52) U.S. Cl. ..... 417/410.1; 419/203; 419/500; 361/695

(58) Field of Classification Search ..... 417/410.1; 416/203, 500; 361/695
See application file for complete search history.

(56) References Cited

U.S. PATENT DOCUMENTS 5,288,216 A * 2/1994 Bolte ..... 417/423.7
5,478,201 A * 12/1995 Amr ..... 415/206
5,588,618 A * 12/1996 Marze et al. ..... 244/17.19
6,505,680 B1 1/2003 Hegde
6,719,530 B2 4/2004 Chow
2007/0031262 A1 2/2007 Kim
2008/0180911 A1 * 7/2008 Kaneko et al. ..... 361/695

OTHER PUBLICATIONS

Ewald et al., "Noise Reduction by Applying Modulation Principles," The Journal of the Acoustical Society of America, vol. 49, No. 5, Part 1, 1971, pp. 1381-1385.

* cited by examiner

*Primary Examiner* — Charles Freay
*Assistant Examiner* — Patrick Hamo
(74) *Attorney, Agent, or Firm* — Womble Carlyle Sandridge & Rice LLP

(57) ABSTRACT

A centrifugal blower in a cooling system of an electronic device having non-uniform blade spacing with acceptable balance. The non-uniform blade spacing is determined according to specific repeating sinusoidal patterns to obtain acoustic artifacts that are favorable and balance that is similar to that found with equal fan blade spacing. The fan impeller can include a prime number of fan blades to prevent higher harmonic interaction among noise sources. The perceived sound quality from the fan is improved with essentially no effect on the thermal performance of the fan.

20 Claims, 7 Drawing Sheets

CENTRIFUGAL BLOWER WITH NON-UNIFORM BLADE SPACING

BACKGROUND

1. Field of the Invention

The invention relates to portable electronic products, and more particularly, to blowers or fans particularly suitable for use in air cooling systems of portable electronic products.

2. Description of the Related Art

Axial and centrifugal fans or blowers are typically implemented in cooling systems of electronic devices to assist in cooling down the electronic devices when they become too hot. Typical fan design includes impellers that have blades spaced at equal angles relative to one another. The evenly spaced fan blades allow the impeller to be balanced. When fan blades are not spaced evenly, the impeller can have acoustic artifacts, imbalance problems, and thermal penalties. Imbalance may lead to increased vibratory stress, wear on the bearing and motor structure of the fan, and quality issues.

Typically, the noise sources of a fan are the air flow and from the motor. One of the flow-induced noise sources is the blade passage frequency (BPF) tone. The BPF and related harmonics are related to pressure disturbances produced when each fan blade passes a fixed reference point. The blade tip creates a periodic pressure wave, which creates a tone.

The major motor noise source is the pole passage frequency (PPF) tone. The PPF is the vibration and resulting pressure waves created by the poles in the motor of the fan. The BPF will usually be perceived as a tone, and can be amplified if it coincides with the PPF. The BPF and PPF tones emanate from a blower or fan, and when audible, can be annoying to the user of the product containing that blower or fan. Another source of noise is from interaction with struts or any other kind of obstruction on the fan. Thus, an adequately balanced fan with reduced noise is desired.

SUMMARY

Broadly speaking, the embodiments disclosed herein describe non-uniform blade spacing with acceptable balance in a centrifugal blower and implementation of the centrifugal blower into portable electronic products. A specific repeating sinusoidal pattern of spacing was developed to obtain acoustic artifacts that are favorable and balance that is similar to that found with equal fan blade spacing. According to an embodiment, the fan impeller includes a prime number of fan blades to prevent higher harmonic interaction among noise sources. If reoccurring, non-uniform spacing is used that does not follow the reoccurring sinusoidal pattern, adequate balance will not be obtained due to the prime number of blades. If used correctly, the perceived sound quality from the fan improves with essentially no effect on the thermal performance of the fan.

An impeller of a centrifugal blower for an electronic device is disclosed. The impeller including at least: a prime number of impeller blades, wherein the impeller blades are spaced non-uniformly about a central hub and the prime number is at least 17 and a plurality of spaces between the impeller blades, wherein an angle of each of the spaces is determined by positions of adjacent impeller blades, wherein the positions of each of the impeller blades corresponds to a unique point on at least two repeating sinusoidal patterns.

A method of manufacturing a fan is disclosed. The method including at least the following operations: providing a motor having a number of pole passes, wherein the number of pole passes is an even number, providing a number of impeller blades, wherein the number of impeller blades is at least 15 and wherein the number is different from the number of pole passes in the motor, and positioning the impeller blades non-uniformly around a central hub such that each blade corresponds to a unique point on at least two repeating sinusoidal patterns.

Other aspects and advantages will become apparent from the following detailed description taken in conjunction with the accompanying drawings which illustrate, by way of example, the principles of the invention.

BRIEF DESCRIPTION OF THE DRAWINGS

The described embodiments will be readily understood by the following detailed description in conjunction with the accompanying drawings, wherein like reference numerals designate like structural elements, and in which.

DETAILED DESCRIPTION OF THE DESCRIBED EMBODIMENTS

The described embodiments relate to a centrifugal fan or blower that can be implemented in a cooling system of a portable electronic device, such as a laptop computer. It is to be understood that the described embodiments can also be used in other non-portable electronic devices, such as desktop computers. The centrifugal fans or blowers in the described embodiments provide air cooling for a portable electronic device while the perceived sound emanating from the fan is decreased when compared to conventional fans.

Embodiments are discussed below with reference to FIGS. 1-5. However, those skilled in the art will readily appreciate that the detailed description given herein with respect to these figures is for explanatory purposes as the invention extends beyond these limited embodiments.

Figure 1:
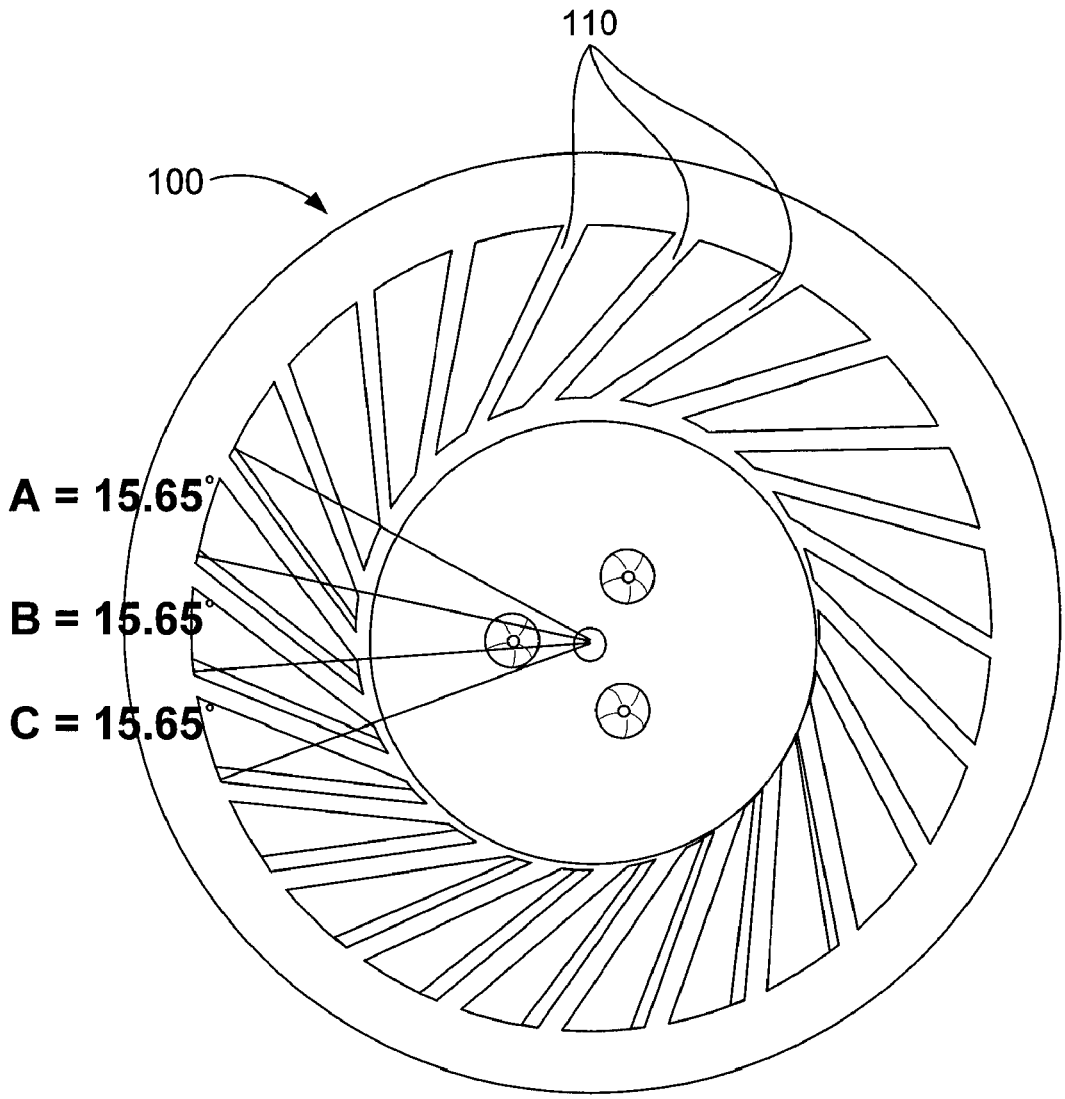
FIG. 1 PRIOR ART
FIG. 1 is a top plan view of an impeller having blades uniformly spaced about a central hub.

As discussed above, typical fan design includes impellers that have uniform blade spacing. That is, the blades 110 of an impeller 100 are spaced at equal angles A, B, C relative to one another, as shown in FIG. 1. As illustrated in FIG. 1, the angles A, B, C between blades 110 are equal to one another. The uniform spacing of the blades 110 provides balance because the mass of the impeller 100 is evenly distributed and also provides a constant tone frequency over time while the fan is spinning. Typically, an impeller 100 has a prime number of blades to avoid having the harmonics of the blades lining up or merging with the harmonics of the poles in the motor. A prime number is typically selected for the number of blades because the pole pass is typically an even number. It will be understood that if the harmonics of the blades and the harmonics of the poles line up, the noise coming from the fan will be increased. Thus, the industry standard is to provide evenly spaced blades when the impeller has a prime number of blades.

Figure 2:
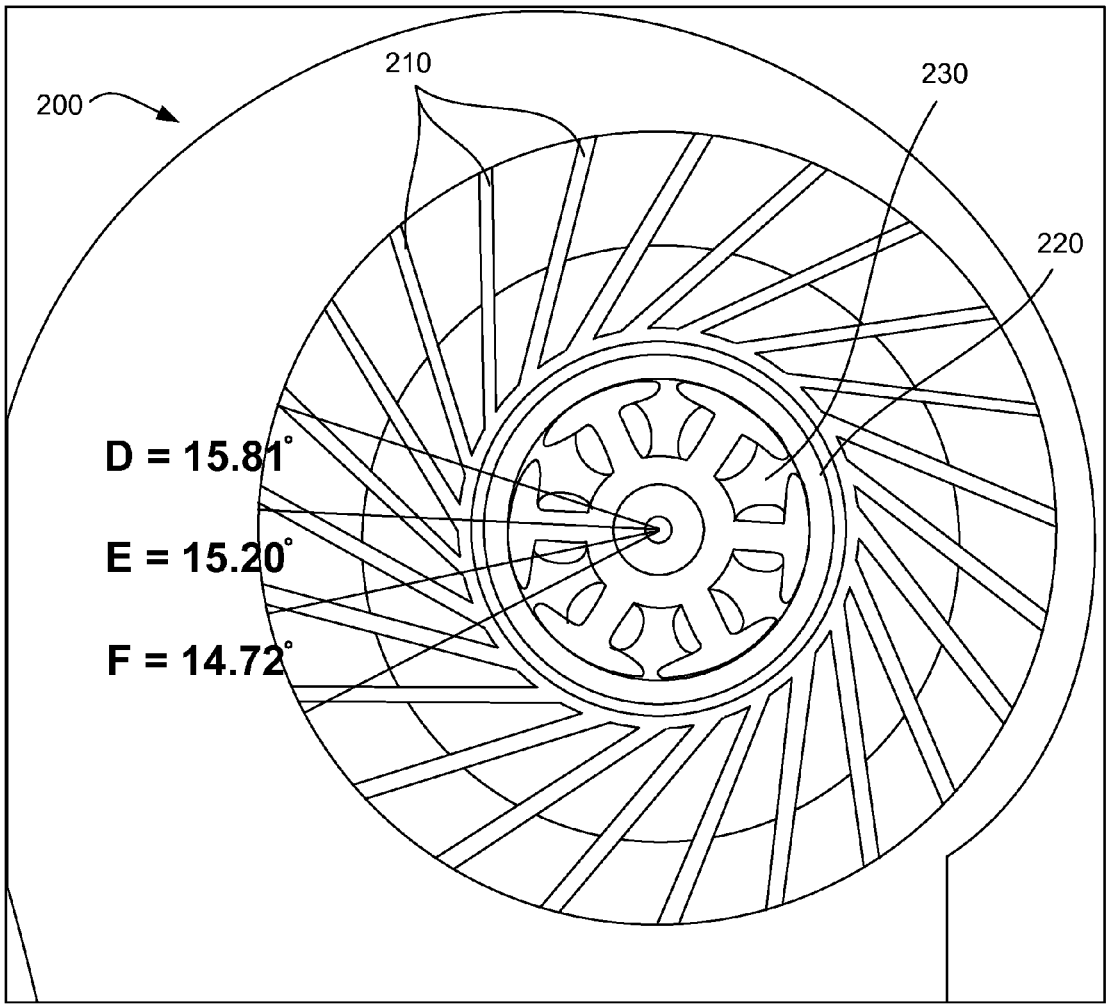
FIG. 2 is a top plan view of an embodiment of an impeller having blades that are not uniformly spaced about a central hub.

One method of minimizing noise from a fan is to control the spectral distribution of pure tones generated by the fan. Dispersing the energy of a tone over a number of discrete frequencies can make the tone seem less noisy to the listener by reducing the perception on the tonal BPF. Spacing fan blades unevenly, while maintaining impeller balance, is one method of controlling pure-tone effects. FIG. 2 illustrates an impeller 200 of a centrifugal blower having unevenly spaced blades 210. As shown, the angles D, E, F are not equal to one another. To determine the spacing of a non-uniform blade spacing arrangement, the positions of evenly spaced fan blades 110 may be modified in a sinusoidal amplitude pattern. An equation that can be used for the modified angle spacing according to sinusoidal modulation is:

$$\theta_i'=\theta_i+\Delta\theta \sin(m\theta_i)$$

where $\theta_i$ is the original spacing angle of the ith blade in an evenly spaced arrangement, $\theta_i'$ is the new spacing angle of the ith blade angle after modification, $\Delta\theta$ is the maximum percentage of spacing angle change (the modulation amplitude), and m is the number of sinusoidal patterns to be used (the number of times the modulation cycle is repeated in a single revolution of the fan). It will be understood that the equation set forth above can be applied to larger fans, such as axial fans, which can be balanced by adding weights in strategic places on the impeller.

The noise resulting from this sinusoidal modulation is represented by the following equation:

$$f(t)=A_0 \sin(2\pi F_0 t+\Delta\phi \sin 2\pi\nu t),$$

where $A_0$ is the amplitude of the fundamental blade passing tone, $F_0=If_s$ (I is the number of blades and $f_s$ is the shaft rotational frequency), the modulation frequency $\nu=m f_s$, and the phase-modulation amplitude $\Delta\phi=I\Delta\theta$.

Figure 3:
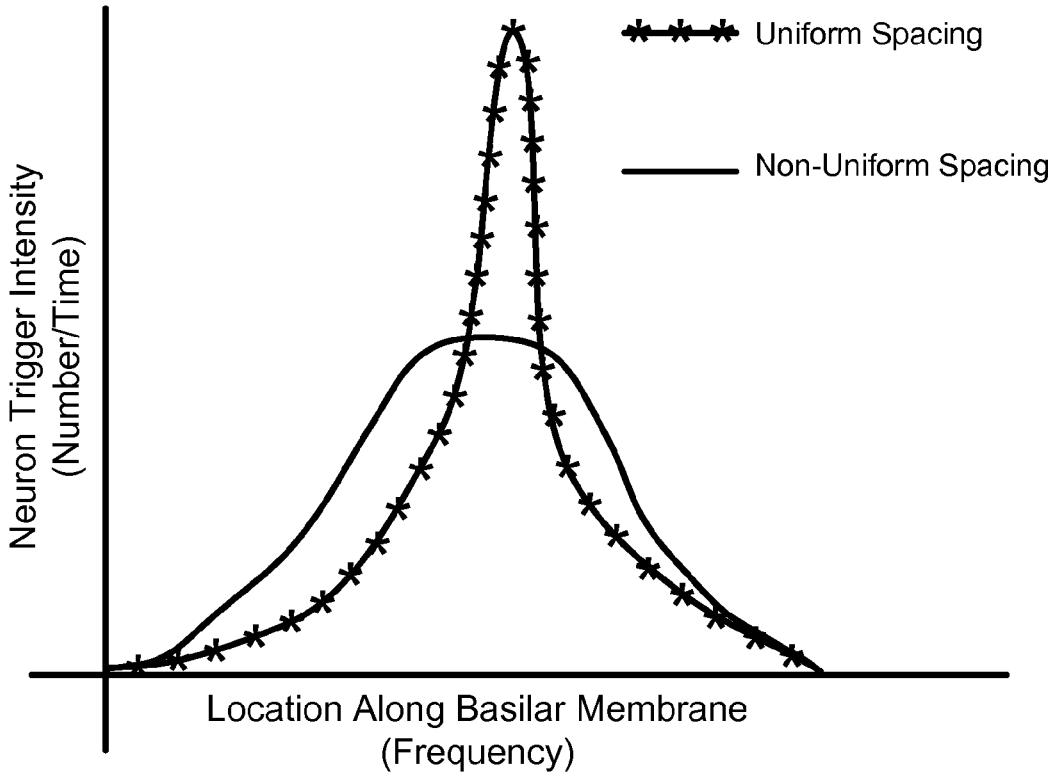
FIG. 3 is a graph comparing the sound frequency distribution along the basilar membrane of an impeller with uniform blade spacing with an impeller with non-uniform blade spacing

The basilar membrane in the human ear has the function of dispersing the frequency of incoming sound waves. The dispersion of the frequency of sound waves causes sound of a certain frequency to vibrate some locations of the basilar membrane more than others. FIG. 3 is a graph comparing the sound frequency distribution along the basilar membrane of an impeller 100 with uniform blade spacing with an impeller 200 with non-uniform blade spacing. A shown in FIG. 3, the noise from the two impellers 100, 200 cause a similar amount of neurons to be fired over the same period of time. However, the impeller 200 with the non-uniform blade spacing causes a greater spread intensity of the sound wave frequency, which decreases the BPF tone. It will be understood that the reduction in measurement of the BPF tone may not completely reflect the reduction in the perceived BPF tone.

In conventional fans, the impeller blades are uniformly spaced to achieve balance. The uniform spacing also provides a constant BPF tone frequency over time when the fan is spinning. When the blades are not spaced uniformly, imbalance may occur and the BPF tone frequency is not constant over time when the fan is spinning. For large fans, weights may be attached in strategic places on certain fan blades for balance. However, weights cannot be used in an efficient manner for small fans, such as those used in portable devices. To achieve acceptable balance in such small fans with non-uniformly spaced blades, balance must be inherent in the design of the fan itself. The embodiments described herein are designed such that the fans are balanced even though the blades are not uniformly spaced about a central hub or shaft of the impeller, and the BPF tone frequency remains constant over time, thereby reducing the noise emanating from the fan. In some embodiments, the blower has a diameter of 150 cm or less.

According to an embodiment, the centrifugal blower has at least 15 impeller blades 210 non-uniformly spaced about and extending out from a central hub or impeller shaft 220. That is, the blades 210 are not evenly spaced apart from one another. To reduce the fan noise, the number of impeller blades 210 is selected to be different from the number of pole passes in the motor 230 to avoid having the harmonics of the blades 210 and the harmonics of the poles merge. If the harmonics of the poles and the harmonics of the blades 210 merge, the BPF and PPF tones are increased, resulting in increased noise emanating from the fan. Consequently, if the harmonics of the poles and blades are not lined up, the perceived noise coming from the fan will be reduced. It will be understood that if there are multiple noise sources in a fan, the noise sources should not line up in order to minimize the noise.

Although the blades 210 are not uniformly spaced, the impeller 200 is still able to maintain acceptable balance when spinning. The angle D, E, F of each of the spaces between the non-uniformly spaced impeller blades is determined by the positions of the blades 210. As shown in FIG. 2, the angles D, E, F between the blades 210 are not equal to one another. Although the positions of the impeller blades 210 are evenly distributed along at least two repeating sinusoidal patterns, the impeller blades 210 are unevenly or non-uniformly spaced about the central hub 220. The angle D, E, F of each of the spaces between the blades 210 is determined by the blade positions. The position of each of the impeller blades 210 corresponds to a unique point on the repeating sinusoidal patterns and can be represented by the following equation:

$$\theta_i'=\theta_i+\theta_i*\alpha*\cos(mx)$$

where $\theta_i$ is the original spacing angle of uniformly spaced blades (number of blades/360°), $\theta_i'$ is the new spacing angle of the ith blade angle after modification in a non-uniform spacing arrangement, $\alpha$ is related to the maximum percentage of spacing angle change (the modulation amplitude $\Delta\theta$), m is the number of sinusoidal patterns to be used (the number of times the modulation cycle is repeated in a single revolution of the fan), $0\leqq x\leqq 2\pi$.

Figure 4:
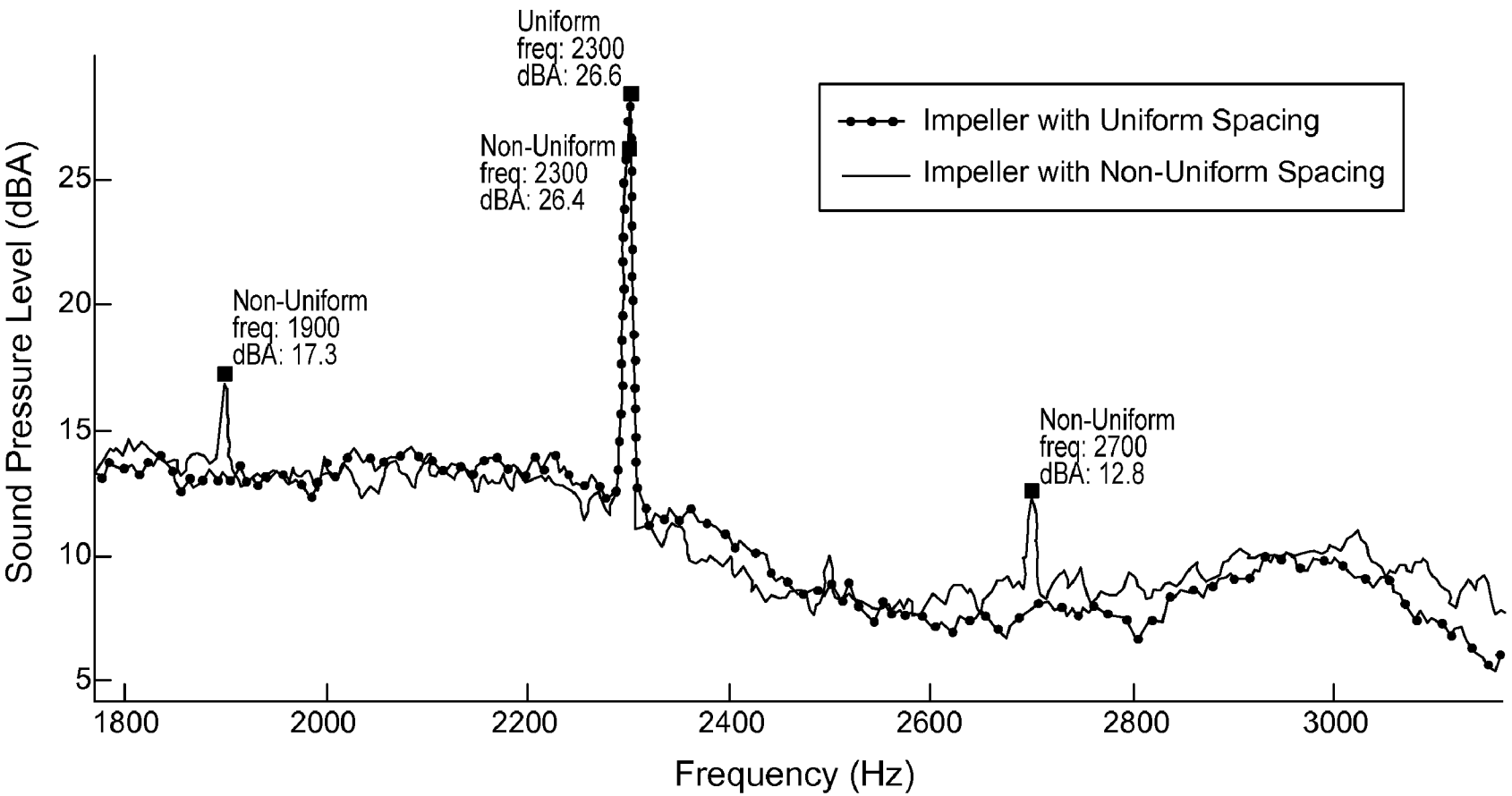
FIG. 4 is a graphical comparison of the sound produced by a fan with uniformly spaced impeller blades and a fan with non-uniformly spaced impeller blades.

FIG. 4 illustrates the noise reduction provided by a fan having non-uniformly spaced impeller blades according to an embodiment. FIG. 4 is a graphical comparison of the sound produced by a fan with uniformly spaced impeller blades and a fan with non-uniformly spaced impeller blades. In this embodiment, as shown in FIG. 4, the main tone (at about 2300 Hz) is reduced in the non-uniformly spaced fan and side bands (at about 1900 Hz and 2700 Hz) are introduced. The side bands represent the dispersion of the frequency of the sound waves, resulting in a reduction in the noise. It will be understood that the perceived noise reduction can be even greater than the measured reduction in noise.

Figure 5:
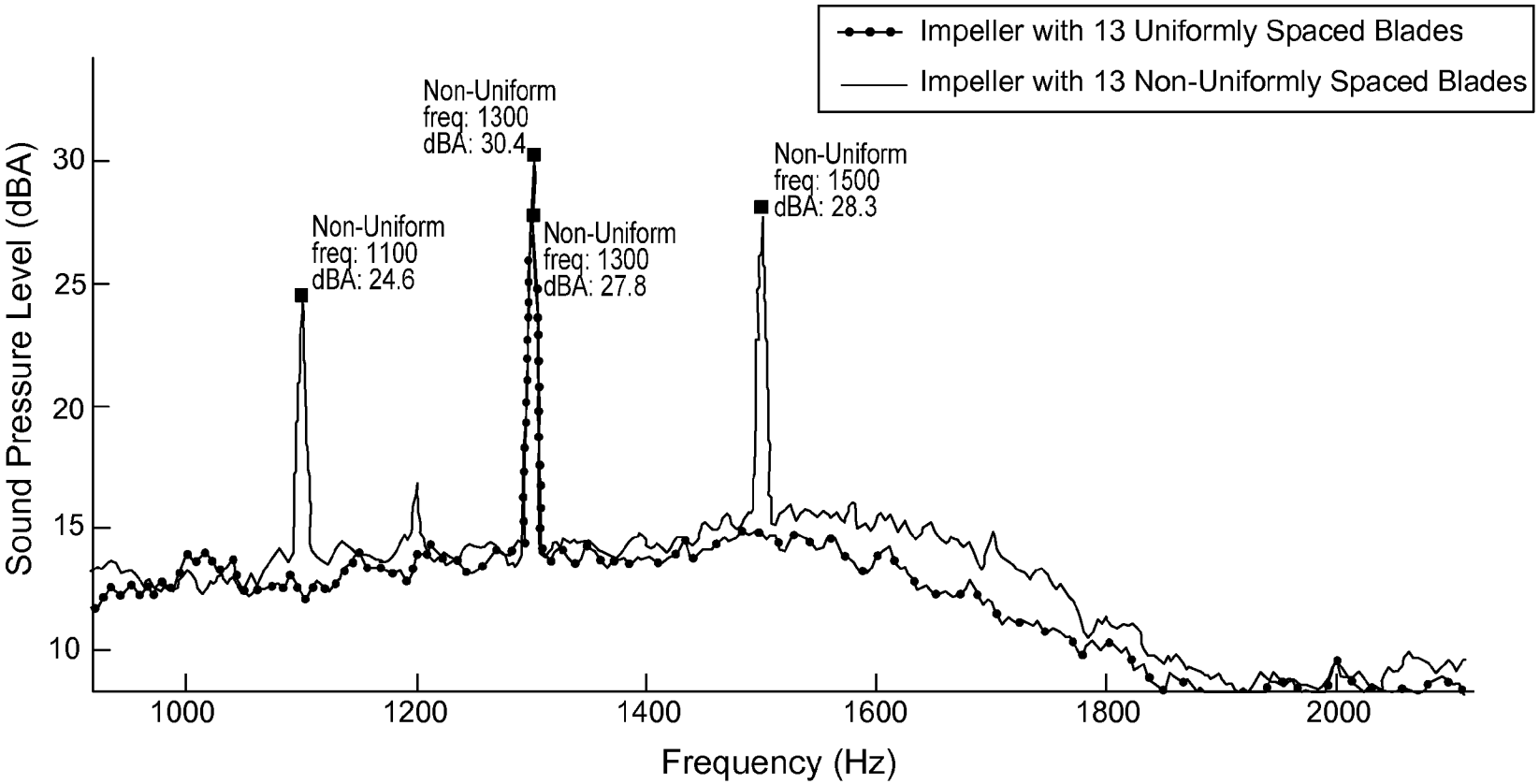
FIG. 5 is a graphical comparison of the sound produced by a fan with uniformly spaced impeller blades and a fan with 13 non-uniformly spaced impeller blades.

As discussed above, the fan has at least 15 impeller blades. According to an embodiment, there are 17 impeller blades non-uniformly spaced about the central hub. In another embodiment, there are 23 non-uniformly spaced impeller blades. In some embodiments, the impeller has 29 blades or fewer. If there are too few blades, unwanted modulation artifacts can be introduced, thereby boosting the noise emanating from the fan, as shown in FIG. 5. As shown in FIG. 5, the fan with 13 non-uniformly spaced impeller blades produces not only a higher main tone (at about 1300 Hz) than the fan with the uniformly spaced impeller blades, but also high side bands (at about 1100 Hz and 1500 Hz).

As discussed above, the position of each of the impeller blades 210 about the central hub 220 corresponds to a unique point on at least two repeating sinusoidal patterns. At least two repeating sinusoidal patterns are used to maintain balance. According to an embodiment, an even number of repeating sinusoidal patterns is used. That is, the blades 210 are spaced according to an even number of sinusoidal patterns. In an embodiment with a single fan, two repeating sinusoidal patterns are used. In certain embodiments, four repeating sinusoidal patterns are used. The skilled artisan will appreciate that, in some embodiments, more than one fan is implemented in the device and that two or four repeating sinusoidal patterns are used. Preferably, no more than four repeating sinusoidal patterns are used. Thus, it is particularly effective when $2 \leqq m \leqq 4$. The skilled artisan will appreciate that the cosine in the equation may be replaced with sine, using the following equation:

$$\theta_i' = \theta_i + \theta_i * \alpha * \sin(mx)$$

In an embodiment, the variable $\alpha$, which is related to the maximum percentage of spacing angle change, is particularly effective when kept in a range of about 0.01 to about 0.07. According to another embodiment, $\alpha$ is in a range of about 0.01 to about 0.05. If $\alpha$ is too large, low frequency modulation can be perceived. If $\alpha$ is too small, there may be no perceived reduction in tone. Similarly, the percentage of spacing change from the evenly spaced arrangement is particularly effective in a range of about 1 percent to about 7 percent. That is, each of the blade positions is modified by about 1 percent to about 7 percent compared to evenly spaced impeller blades of an impeller having the same number of impeller blades. The number of sinusoidal patters to be used, m, should equal two when a single fan is used in a system.

According to another embodiment, the centrifugal blower has a prime number of impeller blades that are spaced apart in a non-uniform manner about a central hub. As discussed above, a prime number of blades prevents the harmonics of the blades and the harmonics of the poles from lining up or merging. As the pole pass is typically an even number, selecting the number of impeller blades to be equal to a prime number prevents the BPF tone from merging with the PPF tone.

The number of blades needed and the frequency range that has the largest BPF tone can determine the percentage of variability in the spacing among the blades. The higher the frequency of interest, the more effective the variation is in reducing the perceived tone without introducing other artifacts. The blade passage frequency (BPF) is modulated in frequency and is perceived as less annoying or less strong to the user. The average energy in a small frequency step is reduced, but the modulation must be small enough to not allow perceived low frequency artifacts.

Figure 6:
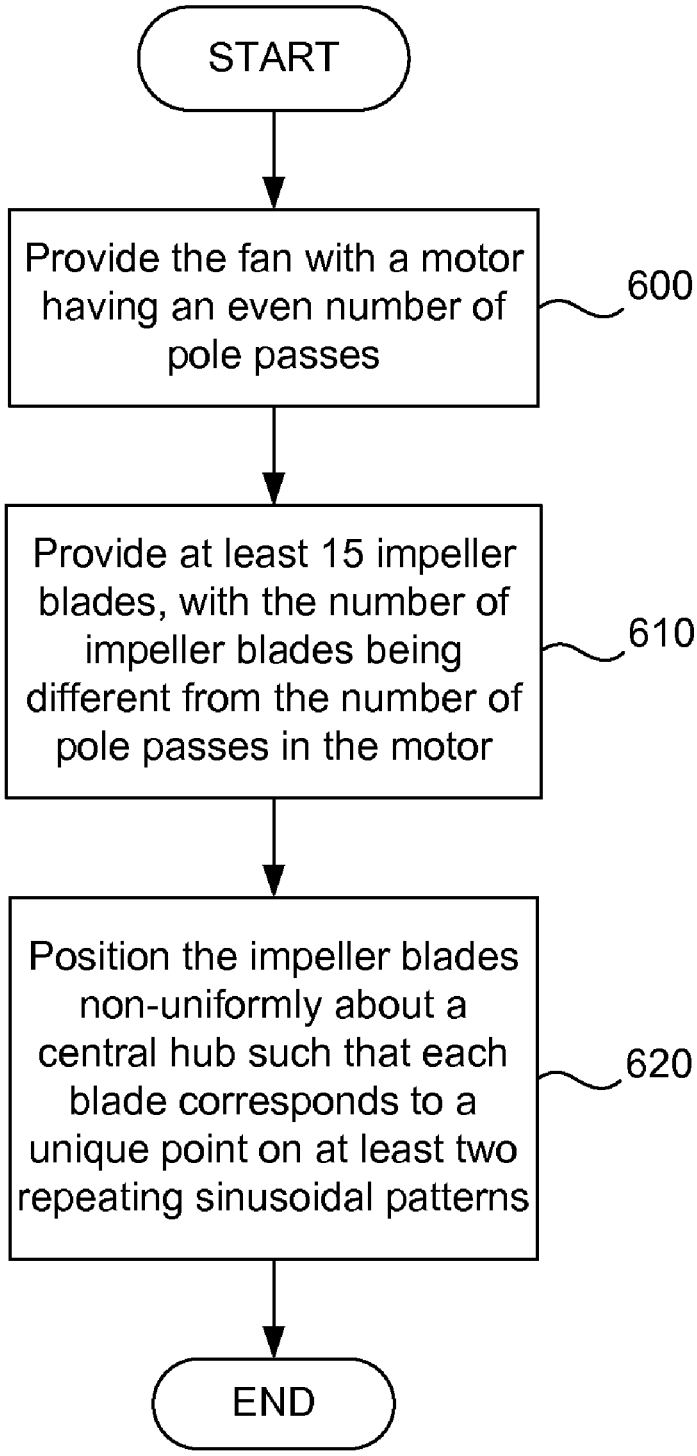
FIG. 6 is a flow chart a method of manufacturing a fan according to a described embodiment.

FIG. 6 is a flow chart a method of manufacturing a fan according to a described embodiment. In step 600, a motor 230 is provided in the fan. The motor 230 has an even number of pole passes. At least 15 impeller blades 210 provided in step 610. The number of impeller blades 210 is different from the number of pole passes in the motor 230. In step 620, the impeller blades 210 are then positioned non-uniformly about a central hub 220 such that each blade 210 corresponds to a unique point on at least two repeating sinusoidal patterns.

Figure 7:
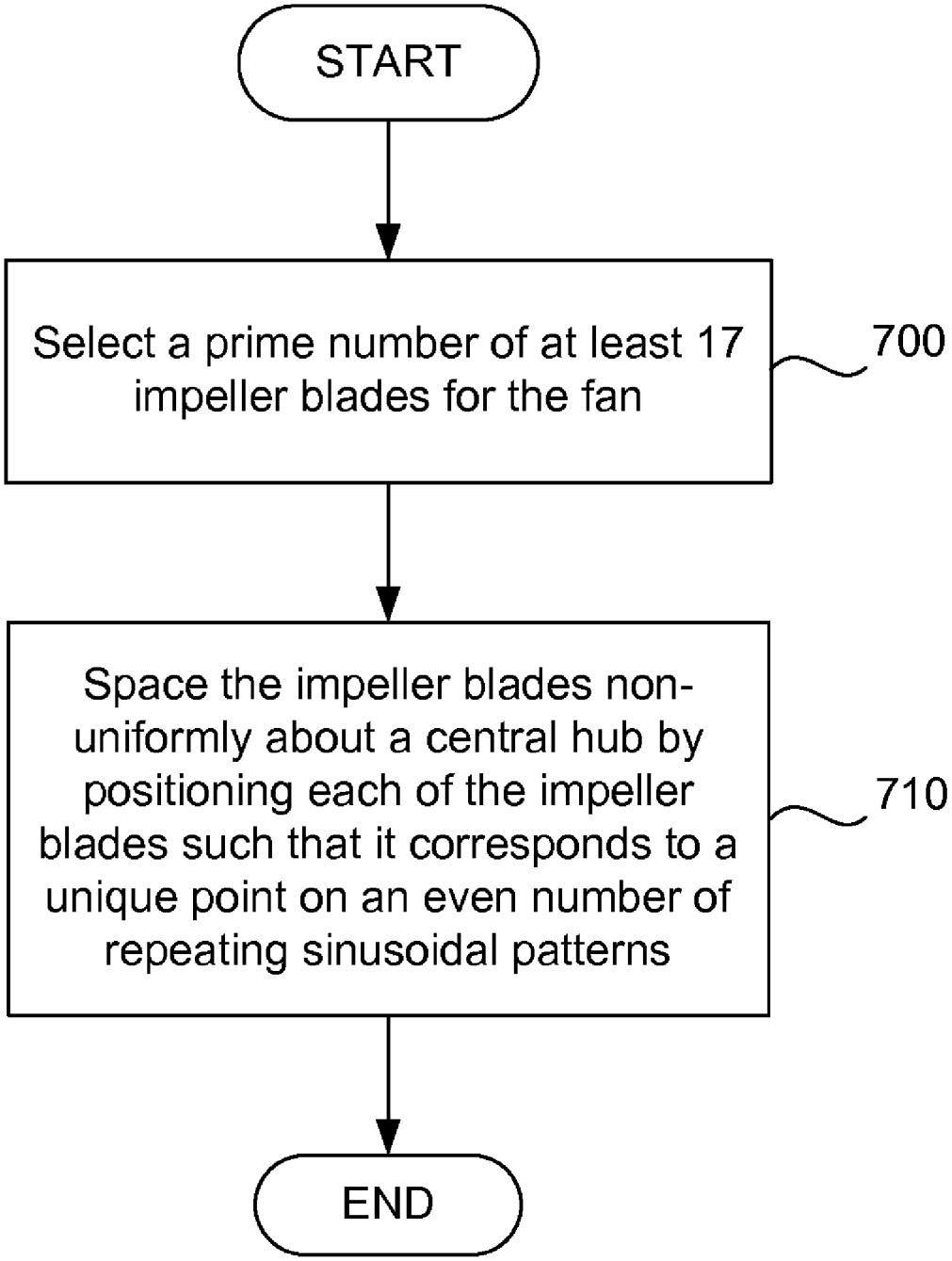
FIG. 7 is a flow chart of a method of manufacturing a fan according to another embodiment.

FIG. 7 is a flow chart of a method of manufacturing a fan according to another embodiment. In step 700, a prime number of at least 17 impeller blades 210 is selected for the impeller. In step 710, the impeller blades 210 are spaced non-uniformly about a central hub by positioning each of the impeller blades such that it corresponds to a unique point on an even number of repeating sinusoidal patterns.

It should be noted that a thin profile has been found to be aesthetically pleasing to a large number of users and is therefore a desirable industrial design consideration in the manufacture of portable electronic devices, such as laptop computers. The centrifugal blowers in the described embodiments can be manufactured in a smaller size as compared to conventional fans. Thus, smaller blowers implemented in portable devices allow the portable devices to have a thin profile. The skilled artisan will appreciate that the embodiments described herein may also be applied to axial fans, which can have a larger size.

The advantages of the invention are numerous. Different aspects, embodiments or implementations may yield one or more of the following advantages. One advantage of the invention is that fan in the device is much quieter and less annoying to a user.

The thermal performance of the fans that utilize the fans described herein are equivalent to the fans before the technique is used. Another advantage of these fans is that the fan impeller can still be balanced, as the center of mass is still located on the shaft of the impeller. Also, the designs in the embodiments described herein allow a fan to be smaller, which in turn, allows a portable device to be smaller.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A centrifugal blower arranged within a portable electronic device, comprising:

a motor having a number of pole passes, wherein the number of pole passes is an even number; and a prime number of impeller blades spaced non-uniformly about a central hub, the prime number of impeller blades being equal to at least 17, wherein each blade position corresponds to a unique point along at least two repeating sinusoidal patterns, and wherein a blade passage frequency of the centrifugal blower does not line up or merge with a pole passage frequency of the centrifugal blower.

2. The centrifugal blower of claim 1, wherein each of the blade positions corresponds to a unique point along four repeating sinusoidal patterns.

3. The centrifugal blower of claim 1, wherein the number of impeller blades is 29 or fewer.

4. The centrifugal blower of claim 3, wherein the centrifugal blower produces a main tone of about 2300 Hz and side band tones of about 1900 Hz and 2700 Hz.

5. The centrifugal blower of claim 3, wherein the centrifugal blower has a diameter of 150 cm or less.

6. The centrifugal blower of claim 1, wherein each of the blade positions is modified by about 1 percent to about 7 percent compared to evenly spaced impeller blades of an impeller having a same number of impeller blades.

7. An impeller of a centrifugal blower for an electronic device, comprising:

a prime number of impeller blades, wherein the impeller blades are spaced non-uniformly about a central hub and the prime number is at least 17, wherein a position of each of the impeller blades corresponds to a unique point along at least two repeating sinusoidal patterns.

8. The impeller of the centrifugal blower of claim 7, wherein the blower comprises at least 23 impeller blades.

9. The impeller of the centrifugal blower of claim 7, wherein a number of the at least two repeating sinusoidal amplitude patterns is even.

10. The impeller of the centrifugal blower of claim 7, wherein the at least two repeating sinusoidal amplitude patterns is four.

11. The impeller of the centrifugal blower of claim 7, wherein the electronic device is a laptop computer.

12. The impeller of the centrifugal blower of claim 7, wherein the positions of each of the impeller blades is modified by about 1 percent to about 7 percent compared to evenly spaced impeller blades of an impeller having a same prime number of impeller blades.

13. A method of manufacturing a fan, comprising:

providing a motor having a number of pole passes, wherein the number of pole passes is an even number;

providing a prime number of impeller blades; and positioning the impeller blades non-uniformly around a central hub such that each blade position corresponds to a unique point along at least two repeating sinusoidal patterns.

14. The method of claim 13, wherein the number of impeller blades is 29 or fewer.

15. The method of claim 14, wherein the number of impeller blades is 17.

16. The method of claim 14, wherein the number of impeller blades is 23.

17. The method of claim 13, wherein each blade position corresponds to a unique point along at least four repeating sinusoidal patterns.

18. The method of claim 13, wherein positioning comprises modifying each of the blade positions of an impeller having a same number of uniformly spaced impeller blades by about 1 percent to about 7 percent.

19. The centrifugal blower of claim 1, wherein positions of the impeller blades are evenly distributed along the at least two repeating sinusoidal patterns.

20. The centrifugal blower of claim 1, wherein the at least two repeating sinusoidal patterns correspond to a single revolution of the centrifugal blower.

* * * * *